US010178910B2

(12) United States Patent
Kurebayashi

(10) Patent No.: US 10,178,910 B2
(45) Date of Patent: Jan. 15, 2019

(54) DRAWER APPARATUS

(71) Applicant: STAR MICRONICS CO., LTD., Shizuoka-shi (JP)

(72) Inventor: Ryo Kurebayashi, Shizuoka (JP)

(73) Assignee: STAR MICRONICS CO., LTD., Shizuoka-Shi (JP)

( * ) Notice: Subject to any disclaimer, the term of this patent is extended or adjusted under 35 U.S.C. 154(b) by 48 days.

(21) Appl. No.: 15/622,232

(22) Filed: Jun. 14, 2017

(65) Prior Publication Data

US 2017/0273457 A1 Sep. 28, 2017

Related U.S. Application Data

(63) Continuation of application No. PCT/JP2015/074494, filed on Aug. 28, 2015.

(30) Foreign Application Priority Data

Feb. 27, 2015 (JP) ..... 2015-039655

(51) Int. Cl.
*A47B 88/473* (2017.01)
*G07G 1/00* (2006.01)
(Continued)

(52) U.S. Cl.
CPC ..... *A47B 88/473* (2017.01); *A47B 88/497* (2017.01); *A47B 88/919* (2017.01);
(Continued)

(58) Field of Classification Search
CPC ..... E05B 47/0012; E05B 47/0607; E05B 65/461; E05B 2047/0021; A47B 88/473;
(Continued)

(56) References Cited

U.S. PATENT DOCUMENTS 3,015,435 A * 1/1962 Hecker ..... G07G 1/0027 235/130 R
5,938,253 A * 8/1999 Szablewski ..... E05B 81/14 292/201

(Continued)

FOREIGN PATENT DOCUMENTS

JP 58-138187 9/1983
JP 02-104490 8/1990

OTHER PUBLICATIONS

EPO, Extended European Search Report of Application No. 15883294.9, dated Apr. 19, 2018.

*Primary Examiner* — Suzanne L Barrett
(74) *Attorney, Agent, or Firm* — Lex IP Meister, PLLC

(57) ABSTRACT

A drawer apparatus capable of locking and unlocking a drawer without position control and motor stop control is provided. A lock frame is released from the hook to be brought into an operable state by unidirectional rotation of a DC motor in an engaged state. A drawer is released from an anchor to be advanced out of the retracted position when the lock frame operates. A planetary gear unit is pushed by the lock frame. A small-diameter planetary gear is thereby shifted from the engaged state to a default state. The anchor is engaged with the drawer when the advanced drawer is pushed back to the retracted position. The hook is engaged with a lock when the advanced drawer is pushed back to the retracted position.

16 Claims, 14 Drawing Sheets

(51) Int. Cl.

| | |
|---|---|
| ***A47B 88/497*** | (2017.01) |
| ***A47B 88/919*** | (2017.01) |
| ***E05B 65/46*** | (2017.01) |
| ***E05B 47/00*** | (2006.01) |
| ***E05B 47/06*** | (2006.01) |

(52) U.S. Cl.
CPC ..... *E05B 47/0012* (2013.01); *E05B 47/0607* (2013.01); *E05B 65/461* (2013.01); *G07G 1/00* (2013.01); *G07G 1/0027* (2013.01); *E05B 2047/0021* (2013.01)

(58) Field of Classification Search
CPC ..... A47B 88/497; A47B 88/919; G07G 1/00; G07G 1/0027
USPC ..... 70/85–88; 292/201, 216; 235/22, 27, 235/7 R, 379
See application file for complete search history.

(56) References Cited

U.S. PATENT DOCUMENTS 6,155,124 A * 12/2000 Wirths ..... E05B 81/14 292/201
6,386,599 B1 * 5/2002 Chevalier ..... E05B 81/14 292/201
6,419,286 B1 * 7/2002 Szablewski ..... E05B 77/24 292/216
6,435,573 B1 * 8/2002 Szablewski ..... E05B 81/14 292/201
6,522,095 B2 * 2/2003 Kachouh ..... E05B 81/14 292/169
6,523,376 B2 * 2/2003 Baukholt ..... E05B 81/14 292/201
7,175,210 B2 * 2/2007 Orzech ..... E05B 81/14 292/201
8,016,329 B2 * 9/2011 Johansson ..... E05B 13/002 292/108
2004/0113438 A1 * 6/2004 Kachouh ..... E05B 81/14 292/201
2004/0174021 A1 * 9/2004 Tensing ..... E05B 81/14 292/216
2004/0212197 A1 * 10/2004 Shoemaker ..... E05B 47/0607 292/216
2011/0227351 A1 * 9/2011 Grosdemouge ..... E05B 81/14 292/201
2013/0320032 A1 * 12/2013 Rahilly ..... E05B 47/0012 221/154
2014/0021843 A1 1/2014 Hashemi et al.
2016/0130840 A1 * 5/2016 Garneau ..... E05B 47/0012 292/201
2016/0208520 A1 * 7/2016 Jordan ..... E05B 65/46
2016/0253646 A1 * 9/2016 Shinmura ..... G06K 15/02 705/21

* cited by examiner

DRAWER APPARATUS

CROSS-REFERENCE TO RELATED APPLICATION

This application is a continuation of International Patent Application No. PCT/JP2015/074494, filed on Aug. 28, 2015, which claimed priority of Japanese Patent Application No. 2015-39655 filed on Feb. 27, 2015. The contents of these applications are incorporated herein by reference in their entirety.

BACKGROUND

(a) Field

The present invention relates to a drawer apparatus such as a cash drawer as used in a POS system.

(b) Description of the Related Art

Conventionally, a drawer apparatus such as a cash drawer is used in a POS system or a cash register to store a bill, a coin, a voucher and other notes. There is a drawer apparatus connected to a printer from which power is supplied. There is another drawer apparatus mounted in a cash register and integrated with a printer. The drawer apparatus has a housing and a drawer adapted to be entirely retracted in the housing. The position where the drawer is entirely retracted may be referred to as a retracted position. The drawer in the retracted position is generally urged by a compression coil spring toward an opening direction. The drawer is provided with a locking mechanism to anchor the urged drawer in the retracted position. The direction the drawer is urged may be referred to as an advancing direction while the condition the drawer is anchored in the retracted position may be referred to as a locked state.

The locked state is released in response to a drawer-kick signal. The drawer in the retracted position is moved in the advancing direction to be opened by urging force of the compression coil spring. The drawer-kick signal is output upon completion of a transaction, for example, upon operation of a cutter apparatus of the printer. The locking mechanism generally uses a solenoid as an actuator (see Japanese Utility Model Application Laid-Open Publication No. 02-104490).

In Japanese Utility Model Application Laid-Open Publication No. 02-104490, there disclosed is a drawer apparatus provided with a drawer urged in an advancing direction by a compression coil spring in a retracted position and with a lock unit anchoring the urged drawer in the retracted position. The lock unit is provided with a hooker having a hook, a locker having a lock to be engaged with the hook in a locked state and with an anchor to be engaged with an engaging portion (such as a stopper frame) of the drawer in the locked state, a tension coil spring urging the hook and the lock in an engaging direction, and a solenoid whose plunger coupled to the hooker. A drawer-kick signal is a power (24V for 0.1 second, for example) supplied to the solenoid. In response to the drawer-kick signal, the plunger of the solenoid is attracted to rotate the hooker to release the hook from the lock. The locker is then rotated by both urging force applied to the drawer by the compression coil spring and urging force applied to the lock by the tension coil spring. Rotation of the locker releases the anchor from the stopper. The drawer is then moved from the retracted position in the advancing direction to be opened.

The plunger makes a metalic collision sound when attracted into a receiver. That makes it difficult to use such a POS apparatus in a store environment requiring silence characteristic such as a boutique counter. Further, the plunger operation requires power supply more than around 5V. That makes it difficult to use a USB bus power supply as far as the drawer apparatus is actuated by the solenoid.

Alternatively, a motor (DC motor) is conventionally used in an environment requiring silence characteristic or in a drawer apparatus using a USB bus power supply. In such a drawer apparatus, the locker engaged with the stopper is rotated by a motion of a cylindrical cam coupled to the motor, thereby to be released from the stopper. This configuration makes no metallic collision sound, thus improving silence characteristic. Adjustment of reduction ratio of a worm gear coupled to the motor would easily allow a use of a USB bus power supply.

SUMMARY

In the conventional drawer apparatus using the motor, however, it is necessary to accurately move the cylindrical cam in a position aligned with the locker both in the locked state and in the unlocked state, requiring position control of the cam by using a sensor and stop control (brake control) of the motor including an application of a reverse current. Further, after the locker is released from the stopper, it is necessary to move the cylindrical cam to a default state in which the locker is aligned with the stopper for another engagement, again requiring position control of the cam and motor stop control. A use of the sensor and a control board for the purpose increases the cost.

The present invention provides a drawer apparatus capable of locking and unlocking a drawer without position control and motor stop control.

A drawer apparatus of the invention comprises a drawer urged in an advancing direction when in a retracted position; a hooker having a hook and a gear; a motor; a transmitter to be shifted from a default state to an engaged state by rotation of the motor, the transmitter being provided with a transmission gear which is separated from the gear in the default state while engaged with the gear in the engaged state to be rotated by torque of the motor; and a locker provided with a lock to be engaged with the hook in a locked state and with an anchor to be engaged with the drawer in the retracted position in the locked state. The locker is released from the hook to be brought into an operable state when the motor is rotated in one direction in the engaged state. The drawer is released from the anchor to be advanced out of the retracted position when the locker is brought into the operable state. The transmitter is pushed by the locker in the operable state. The transmission gear is shifted from the engaged state to the default state when the transmitter is pushed by the locker in the operable state. The anchor is engaged with the drawer when the advanced drawer is pushed back to the retracted position. The hook is engaged with the lock when the advanced drawer is pushed back to the retracted position.

The transmitter is pushed by the operating locker. The transmission gear is shifted from the engaged state to the default state when the transmitter is pushed by the operating locker. The anchor is engaged with the drawer when the advanced drawer is pushed back to the retracted position. The hook is engaged with the lock when the advanced drawer is pushed back to the retracted position.

The drawer apparatus may be provided with a first stopper to stop the locker in a default state in which the locker or the anchor thereof is desirably ready to receive an engaging portion such as a stopper frame of the drawer pushed back to the retracted position. The drawer apparatus may be further provided with a second stopper to stop the transmitter pushed by the locker in the default state. The second stopper may be also served as the first stopper.

The lock may be released from the hook by unidirectional rotation of the motor in the engaged state. The hook may be engaged with the lock when the advanced drawer is pushed back to the retracted position. The drawer apparatus of the invention eliminates the need to control the positions of the hook and the lock for their disengagement or engagement. None of the hook and the lock requires motor reverse control, motor stop control or sensor detection.

The transmitter may be pushed by the locker to thereby shift the transmission gear from the engaged state to the default state. In a state in which the lock is released from the hook, the transmission gear is out of the engaged state. Torque of the motor is not transmitted to the gear, eliminating the need for motor stop control.

In the state in which the lock is released from the hook, the gear is apart from the transmission gear and the locker may be rotated to be engaged with the engaging portion when the drawer is pushed back to the retracted position. This configuration eliminates the need to move the hook to the default state (a ready state for engagement) by motor reverse control, motor stop control or sensor detection.

The lock of the locker may be urged toward the transmitter in the locked state.

A simple configuration such as a spring can be adopted to operate the locker.

In the state in which the lock is released from the hook, the locker may push the transmitter in a direction to separate the transmission gear from the gear by a stronger force than a force to shift the transmitter from the default state to the engaged state by rotation of the motor.

The transmitter is not allowed to be into the engaged state regardless of rotation of the motor as far as the lock is released from the hook.

The transmission gear may desirably be a planetary gear.

The transmitter is shifted from the default state to the engaged state by rotation of the motor and torque of the motor is transmitted to the gear engaged with the planetary gear.

The gear may be released from the transmission gear when the transmission gear continues to be unidirectionally rotated in the engaged state.

The gear may have gear tooth arranged in the shape of an arc.

In the case the drawer is disturbed by a user or forcibly locked by a key, the locker is kept stationary to prevent the transmitter from being shifted from the engaged state to the default state. Rotation of the motor is possibly stopped when the engaged state is continued beyond the rotational range of the hooker. The risk of motor lock is eliminated by using the gear having the predetermined number of tooth to release the engaged state within the rotational range of the hooker.

The lock may be rotated to move toward the transmitter.

The drawer may further comprises an urging member adapted to urge the lock toward the transmitter in the locked state.

When the lock is released from the hook, the transmitter is pushed by the locker by urging force of the urging member. A simple component such as a spring is useful to shift the transmitter from the engaged state to the default state.

The urging member may further urge the hook toward the lock in the locked state.

Using the urging member commonly for both the lock and the hook eliminates the number of components.

The present invention provides a drawer apparatus capable of locking and unlocking a drawer without position control and motor stop control.

BRIEF DESCRIPTION OF THE DRAWINGS

FIG. 5A-1, FIG. 5A-2, FIG. 5A-3, FIG. 5B-1, FIG. 5B-2, and FIG. 5B-3 respectively shows a manner in which a locked state of the lock unit is released.

FIG. 6A-4, FIG. 6A-5, FIG. 6B-4, FIG. 6B-5, and FIG. 6C-5 respectively shows a continuing manner in which the locked state of the lock unit is released.

FIG. 7C-1, FIG. 7C-2, FIG. 7D-1, and FIG. 7D-2 respectively shows a manner in which components of the lock unit in the locked state are operated when a drawer-kick signal is output while a drawer is disturbed by a user or forcibly locked by a key.

FIG. 8E-1 and FIG. 8E-2 respectively shows a manner in which the lock unit with a lock frame in a default state as shown in FIG. 6B-5 is brought into the locked state as shown in FIG. 5B-1 when the drawer is pushed back to the retracted position.

DETAILED DESCRIPTION

Figure 1:
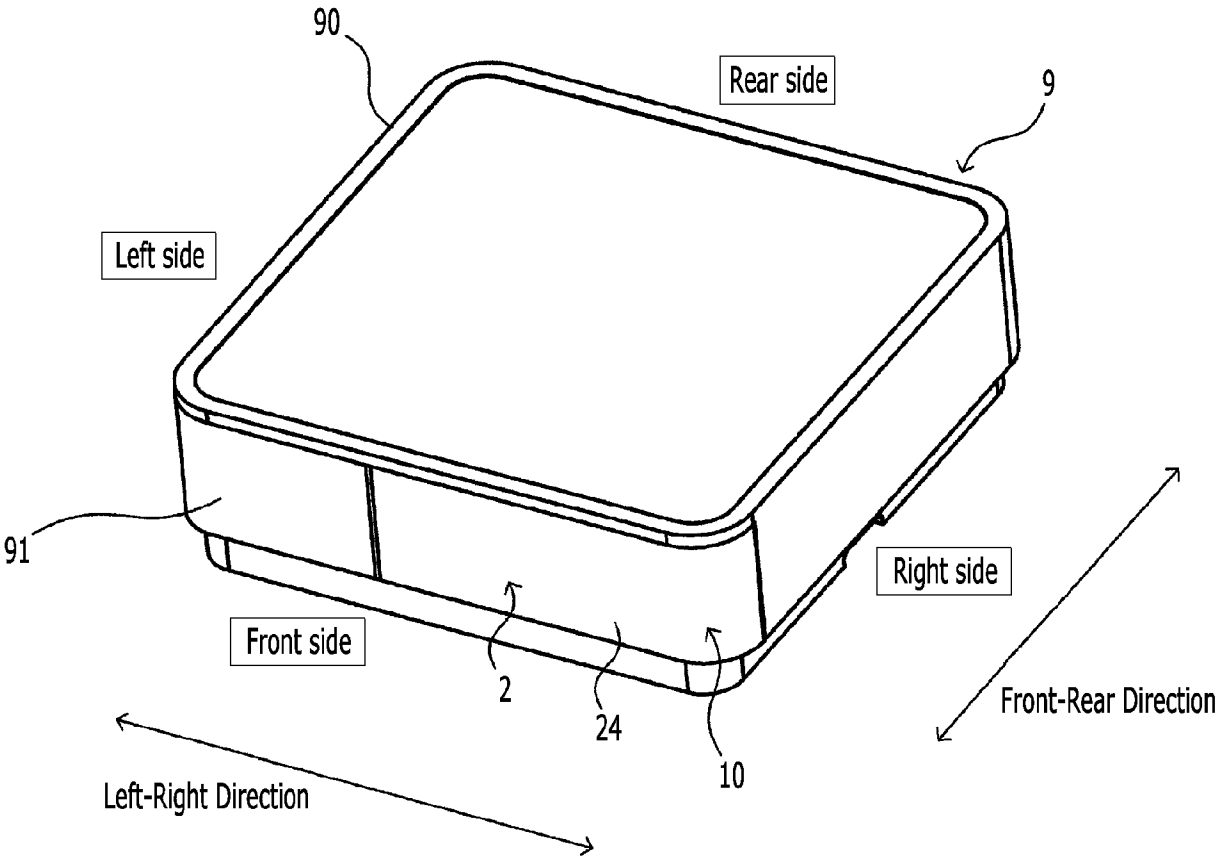
FIG. 1 is a perspective view of a POS apparatus provided with a cash drawer.

An embodiment of the present invention is being described referring to the drawings. A drawer apparatus of the invention may be embodied in a cash drawer including a cash drawer for a POS (Point of Sale) system and a cash drawer for a cash register. The embodiment refers to a cash drawer integrated with a printer. The invention may be also applied to such a drawer apparatus as used in furniture or kitchen.

FIG. 1 is a perspective view of a POS apparatus 9 provided with a cash drawer 10 corresponding to the drawer apparatus of the invention. The POS apparatus 9 is connected with a not-shown POS terminal to deal with a receipt and money according to a transaction done by the POS terminal. The POS apparatus 9 comprises a not-shown printer enclosed in a housing 90 and with the cash drawer 10 whose drawer 2 is enclosed in the housing 90. On the front side of the printer, a printer cover 91 is provided. On the front side of the drawer 2, a front plate 24 is provided. The front plate 24 of the drawer 2 may be coplanar with the printer cover 91 in the left-right direction desirably in appearance. The drawer 2 in this embodiment is positionally adjustable in the front-rear direction, whose configuration will be described later. The drawer 2 of the cash drawer 10 is diagonally moved forward in the lower left direction in FIG. 1. The direction in which the drawer 2 is moved may be referred to as an advancing direction. The lower left side of the POS apparatus 9 and the cash drawer 10 is the front side thereof while the upper right side is the rear side. Hereinafter, the right side of the POS apparatus 9 and the cash drawer 10 viewed from the front side thereof may be referred to as the right side and the left side viewed from the front side thereof will be referred to as the left side. Further, the direction connecting the front side and the rear side may be referred to as the front-rear direction and the direction connecting the left side and the right side may be referred to as the left-right direction. The POS apparatus 9 may be connected with the not-shown POS terminal by a USB cable. Either of the POS apparatus and the POS terminal may be supplied with USB bus power from the other.

Figure 2:
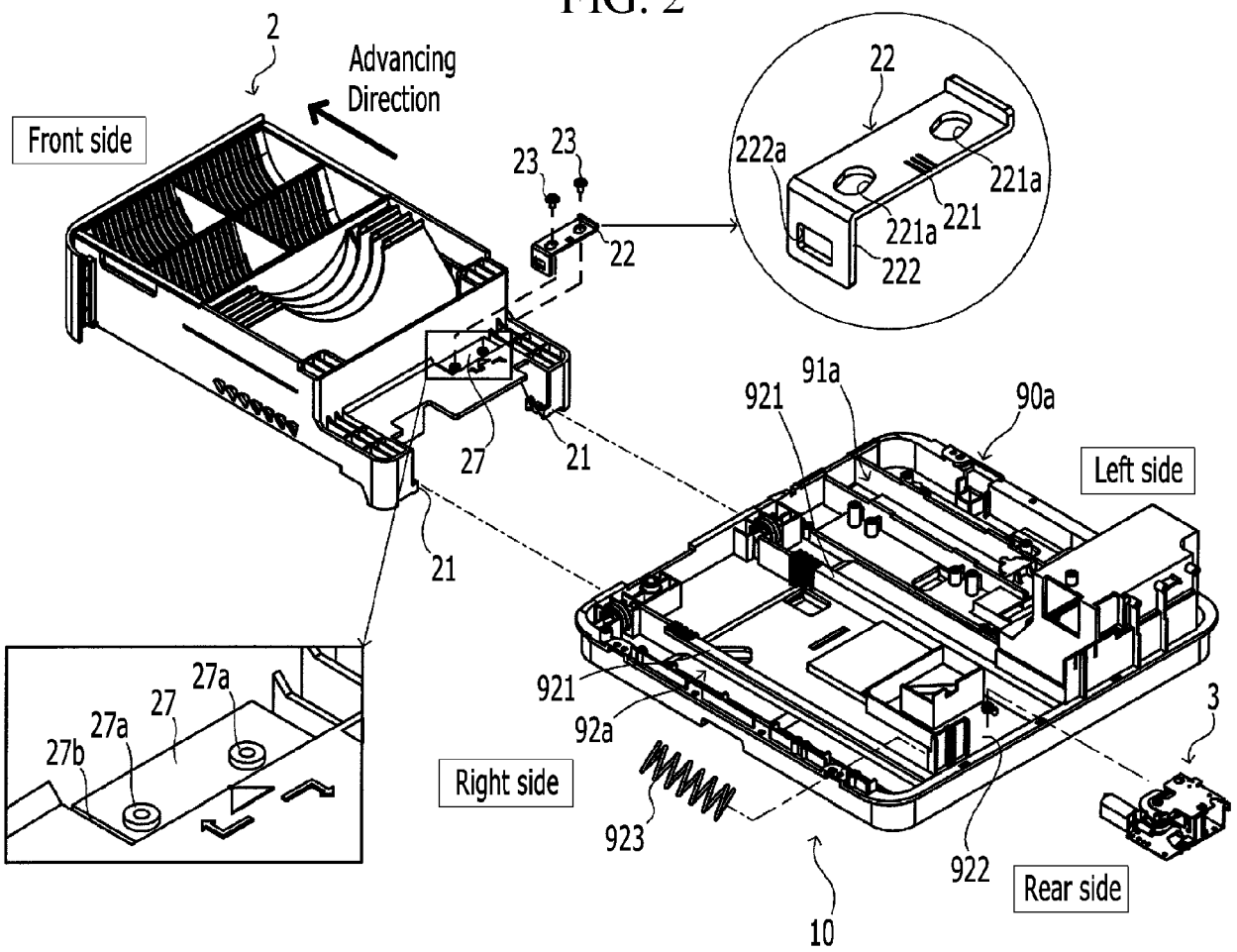
FIG. 2 is an exploded perspective view of the POS apparatus.

FIG. 2 is an exploded perspective view of the POS apparatus 9. The housing 90 is not shown other than a housing base 90*a*. The printer enclosed in the housing is not shown. The POS apparatus 9 is diagonally viewed from the right rear side. The upper left side of the POS apparatus 9 is the front side thereof while the lower right side is the rear side.

The cash drawer 10 comprises the drawer 2 and a lock unit 3. The drawer 2 is provided with a pair of left and right slides 21 at the rear end thereof. The housing base 90*a* has a printer-side base 91*a* and a drawer-side base 92*a* where a pair of left and right rails 921 are provided to match the slides 21 of the drawer 2. The drawer 2 is diagonally advanced in the upper left direction in FIG. 2 and retracted into the housing 90 with the slides 21 guided on the rails 921 in the opposite direction. The drawer 2 is provided with a mounting portion 27 at the rear end thereof on which a stopper frame 22 is fastened. FIG. 2 shows an enlarged view of the mounting portion 27 in a square while the stopper frame in a circle. The mounting portion 27 is provided with a pair of upward-protruding bosses 27*a* and a cutout 27*b* at the right end thereof. The stopper frame 22 includes a fastening portion 221 extending in the left-right direction and an engaging portion 222 extending downward from the right end of the fastening portion 221 at an angle of 90 degrees thereto. The fastening portion 221 is provided with a pair of through-holes 221*a* through which the pair of bosses 27 are respectively inserted. The engaging portion 222 is provided with an engaging hole 222*a* in the shape of a substantially rectangle. The fastening portion 221 is placed on the mounting portion 27 with the bosses 27*a* respectively inserted into the through-holes 221*a* and the engaging portion 222 protruding downward through the cutout 27*b*. Screws 23 are then respectively joined on the pair of bosses 27*a* to fasten the stopper frame 22 to the mounting portion 27. The engaging portion 222 protruding downward through the cutout 27*b* is a portion with which a lock frame 7 is to be engaged, as described below referring to FIGS. 3A, 3B, and 3C.

At the rear end of the drawer-side base 92*a*, a compression coil spring 923 is coupled in a manner to extend in the front-rear direction and a container 922 is provided to accommodate the lock unit 3 therein. When the lock frame 7 of the lock unit 3 is engaged with the stopper frame 22, the drawer 2 is anchored in the retracted position enclosed in the housing 90 in an urged manner in the advancing (forward) direction by the compression coil spring 923.

Figure 3A:
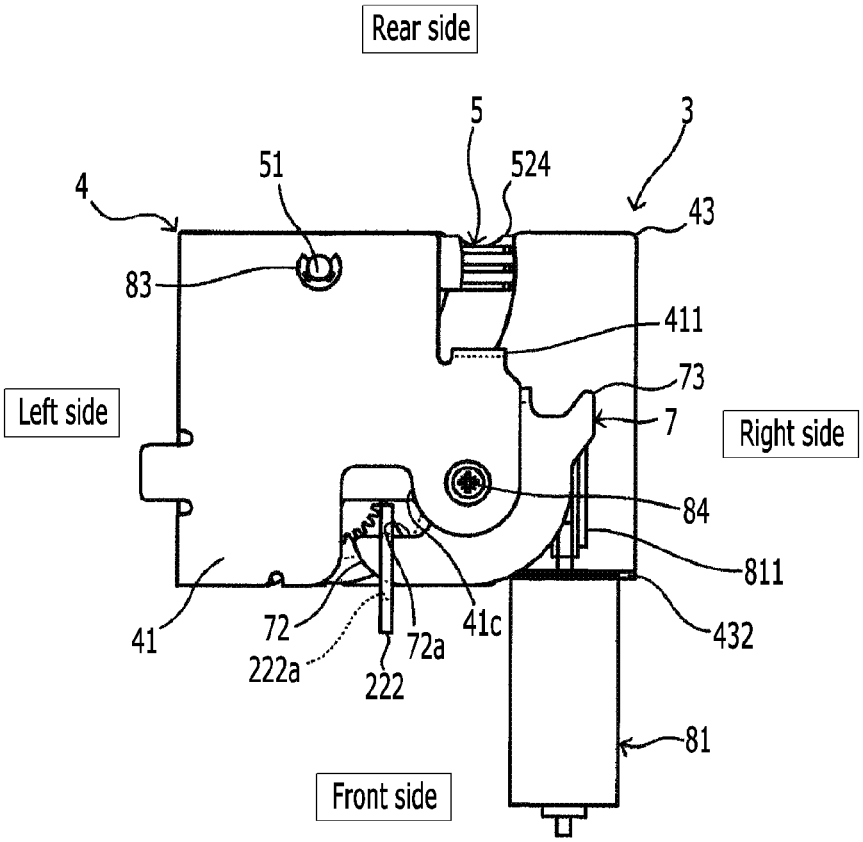
FIG. 3A is a plan view of a lock unit as shown in FIG. 2.
Figure 3B:
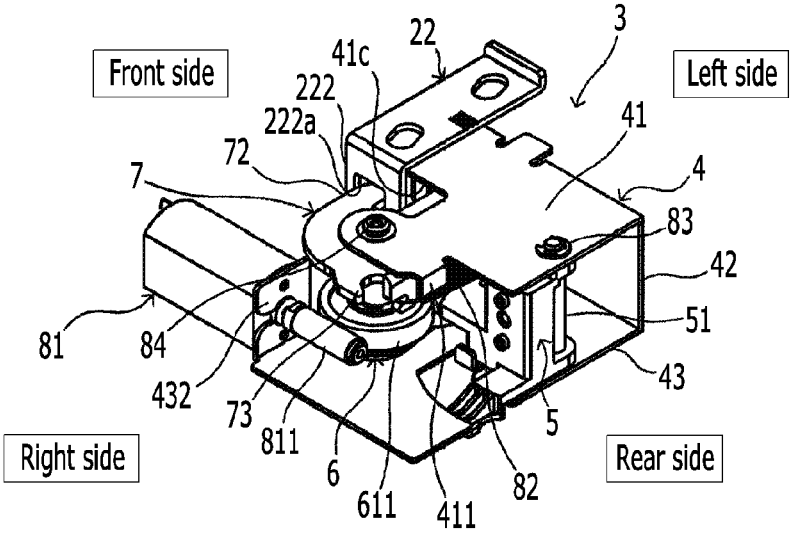
FIG. 3B is a perspective view of the lock unit.
Figure 3C:
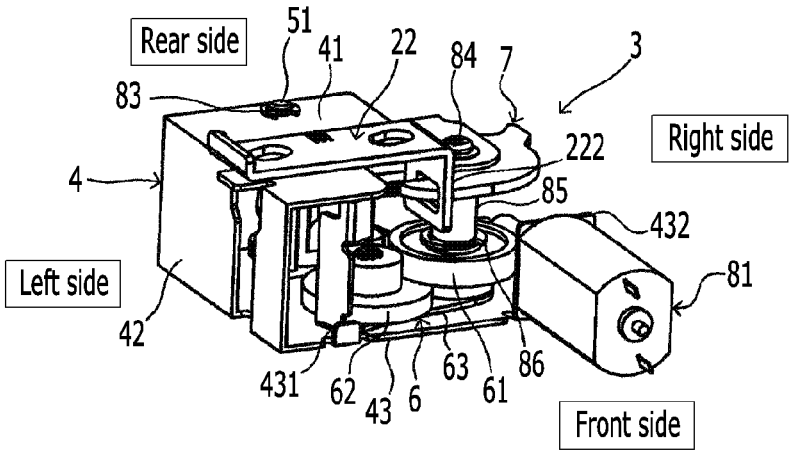
FIG. 3C is a perspective view of the lock unit.
Figure 4:
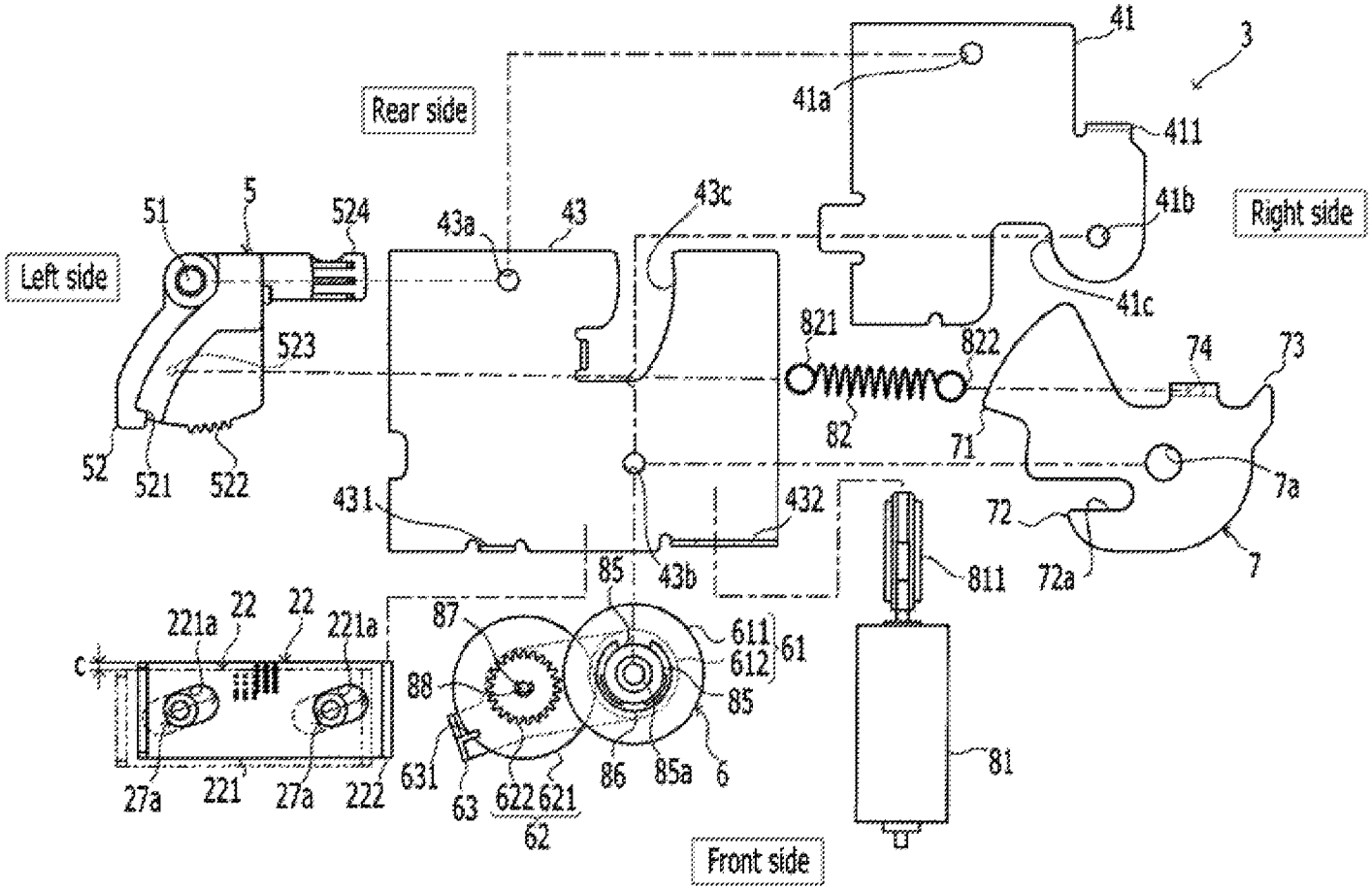
FIG. 4 is an exploded plan view of the lock unit.
Figures 1, 5A:
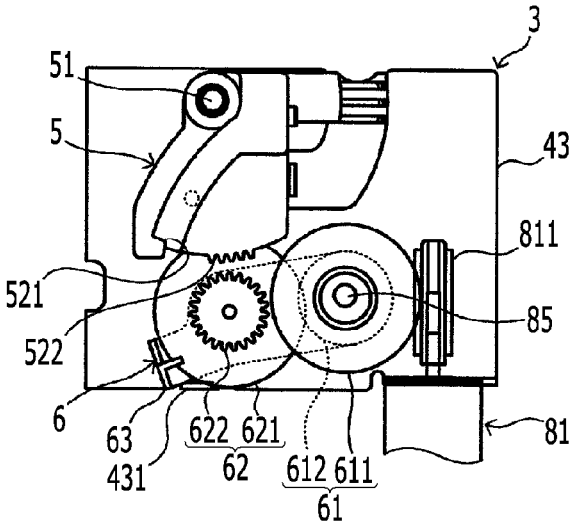
Figures 1, 5B:
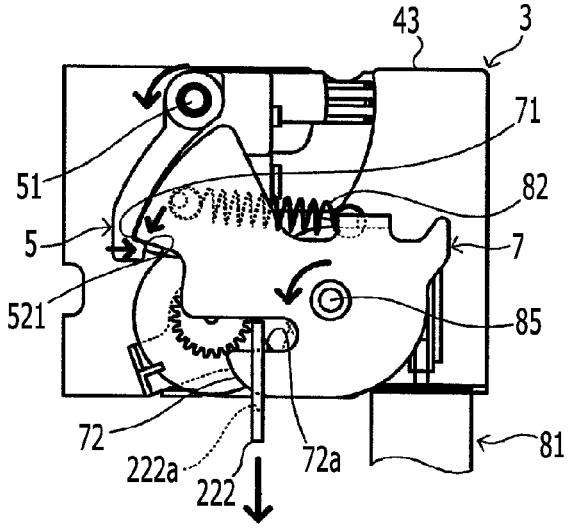
Figures 2, 5A:
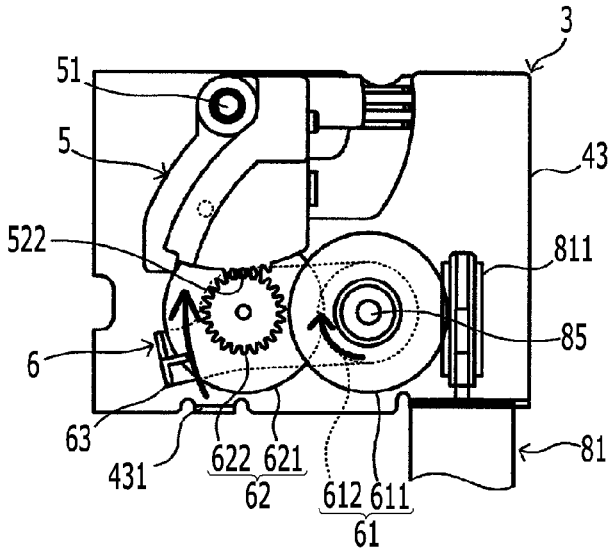
Figures 2, 5B:
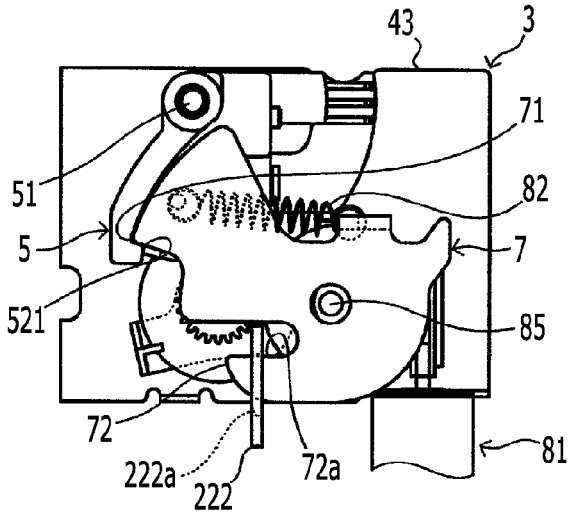
Figures 3, 5A:
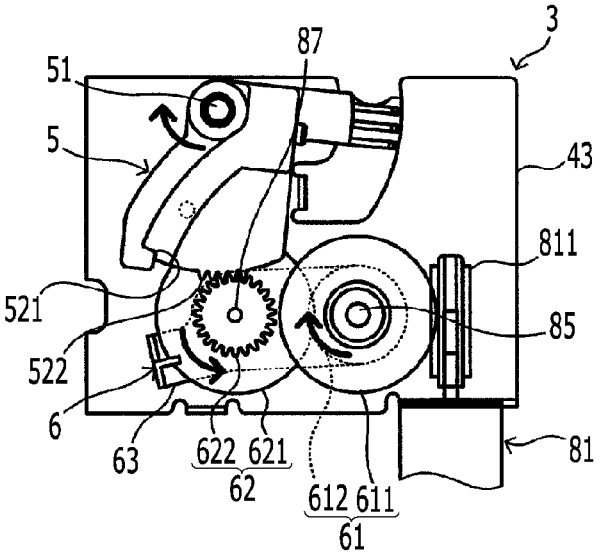
Figures 3, 5B:
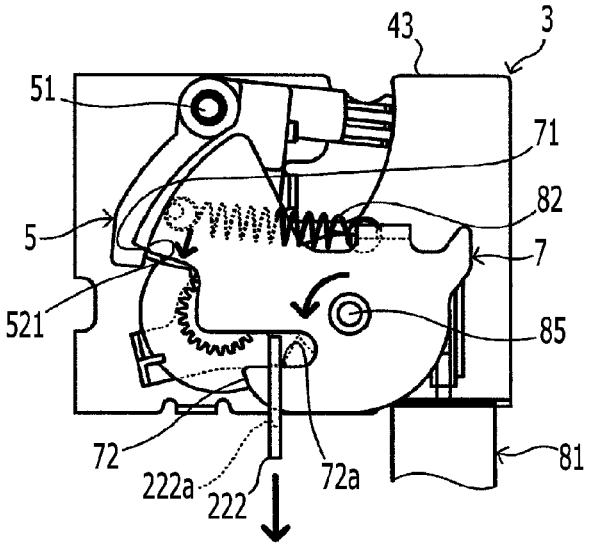

The lock unit 3 is being described referring to the drawings. FIG. 3A is a plan view of the lock unit 3. FIG. 3B is a perspective view of the lock unit 3 viewed from the right rear side. FIG. 3C is a perspective view of the lock unit 3 viewed from the left front side. FIG. 3 totally shows a locked state in which the lock frame 7 is engaged with the engaging portion 222 by using the whole or part of the stopper frame 22. FIG. 4 is an exploded plan view of the lock unit 3 including a top plate 41 and a bottom plate 43 constituting a base frame 4. The base frame 4 further comprises a not-shown side plate 42. FIG. 4 also shows the stopper frame 22.

The lock unit 3 includes the base frame 4, a hook gear 5, a planetary gear unit 6, the lock frame 7, a DC motor 81, and a tension coil spring 82. The DC motor 81 has a worm gear 811 coupled on an output shaft thereof.

The base frame 4 includes the bottom plate 43 in the shape of a substantially rectangle, the top plate 41 smaller than the bottom plate 43 in the left-right direction, and the side plate 42 connecting the left end of the bottom plate 43 and the left end of the top plate 41 as shown in FIG. 3B and FIG. 3C. The bottom plate 43 is provided with a through-hole 43*a*, a through-hole 43*b*, and a cutout 43*c* cut out from the rear side. The bottom plate 43 is further provided with a second stopper 431 and a motor mounting part 432 bent upward from the front end thereof. The second stopper 431 stops the rotation of the planetary gear unit 6 as described below. On the motor mounting part 432, the DC motor 81 is mounted.

The top plate 41 is provided with a through-hole 41*a* and a through-hole 41*b* respectively in a position vertically corresponding to the through-hole 43*a* and the through-hole 43*b* of the bottom plate 43. The top plate 41 is provided with a cutout 41*c* cut out from the front side and further with a first stopper 411 bent downward. The cutout 41*c* is formed to avoid interference with the engaging portion 222 in the locked state. The first stopper 411 stops the rotation of the lock frame 7 as described below.

As shown in FIGS. 3A, 3B, and 3C, the hook gear 5, the planetary gear unit 6 and the lock frame 7 are arranged in a region enclosed by the bottom plate 43, the side plate 42, and the top plate 41.

As shown in FIG. 4, the hook gear 5 includes a pivot 51 extending in the up- and down direction and a hook gear body 52. The hook gear body 52 includes a hook 521, a gear 522 having a plurality of gear tooth (five tooth in the embodiment arranged in the shape of an arc, a projection 523 on which an end 821 of the tention coil spring 82 is mounted, and a guide 524 inserted in the cutout 43*c* of the bottom plate 43 with the leading end thereof positioned below the bottom plate 43. The pivot 51 is inserted through the through-hole 43*a* of the bottom plate 43 and the through-hole 41*a* of the top plate 41. A C-shape retaining washer 83 is joined on a portion of the pivot 51 above the top plate 41 as shown in FIG. 3A. The hook gear body 52 is thereby mounted on the base frame 4 to be rotatable around the pivot 51. The hook gear 5 is an example of a hooker and the hook 521 is an example of a hook.

As shown in FIG. 3C, a shaft 85 is provided in the up- and down direction between the top plate 41 and the bottom plate 43 with a lower-end portion thereof inserted through the planetary gear unit 6 and an upper-end portion thereof inserted through the lock frame 7. The shaft 85 is fastened by a screw 84 from above the top plate 41 and by a not-shown screw from below the bottom plate 43. The lock frame 7, the shaft 85, and the planetary gear unit 6 are thereby mounted between the top plate 41 and the bottom plate 43.

As shown in FIG. 4, the planetary gear unit 6 includes a base 63, a two-step sun gear 61, and a two-step planetary gear 62. The base 63 is provided with a through-hole through which the shaft 85 through the two-step sun gear 61 is inserted. The base 63 is further provided with an abutment part 631 hit by the lock frame 7. The two-step sun gear 61 includes a smaller-diameter driving gear 612 and a larger-diameter worm wheel 611 positioned thereabove. A C-shape retaining washer 86 is joined on the upper end of the worm wheel 611. The two-step sun gear 61 and the base 63 are thereby mounted on the base frame 4 to be rotatable around the shaft 85.

The two-step planetary gear 62 includes a larger-diameter planetary gear 621 and a smaller-diameter planetary gear 622 positioned thereabove. The two-step planetary gear 62 is mounted on the base 63 to be rotatable around a pin 87. A not-shown spring is mounted between the the two-step planetary gear 62 and the base 63. A C-shape retaining washer 88 is joined on the two-step planetary gear 62 with the not-shown spring retained in a compressed state. Rotation of the two-step planetary gear 62 around the pin 87 generates friction with respect to the not-shown spring, producing a certain torque causing the planetary gear unit 6 and the base 63 to rotate around the shaft 85. The two-step planetary gear 62 is also revolved around the shaft 85. The two-step planetary gear 62 is rotated around the pin 87 and also revolved around the shaft 85.

As shown in FIG. 3B, the worm wheel 611 of the two-step sun gear 61 is engaged with the worm gear 811 of the DC motor 81. Torque of the DC motor 81 is transmitted to the two-step sun gear 61. As shown in FIG. 4, the driving gear 612 of the two-step sun gear 61 is engaged with the larger-diameter planetary gear 621 of the two-step planetary gear 62. Torque of the DC motor 81 is transmitted to the larger-diameter planetary gear 621. Rotation of the two-step planetary gear 62 generates friction with respect to the not-shown spring to cause the two-step planetary gear 62 to revolve around the shaft 85 without rotation around the pin 87 and also to cause the base 63 to rotate around the shaft 85, thereby bringing the smaller-diameter planetary gear 622 into engagement with the gear 522 of the hook gear 5, as shown in FIG. 5A-2. In this engaged state, torque of the DC motor 81 is transmitted to the smaller-diameter planetary gear 622. The smaller-diameter planetary gear 622 is rotated around the pin 87 and then the hook gear 5 around the pivot 51. The smaller-diameter planetary gear 622 is an example of a transmission gear and the planetary gear unit 6 is an example of a transmitter.

The lock frame 7 is a thin plate provided with a through-hole 7*a* through which an upper-end 85*a* of the shaft 85 is inserted as shown in FIG. 4. The lock frame 7 is rotated around the shaft 85. The lock frame 7 is provided with a lock 71 and an anchor 72. The lock 71 is engaged with the hook 521 of the hook gear 5 in the locked state as shown in FIG. 5B-1 while the anchor 72 is engaged with the engaging portion 222 of the stopper frame 22 in the locked state as shown in FIG. 3A. FIG. 4 shows the lock frame 7 in the locked state where an engaging surface 72*a* of the anchor 72 is extended in a direction substantially parallel to the left-right direction. The engaging surface 72*a* is engaged with the engaging hole 222*a* in the locked state as shown in FIG. 3A to anchor the drawer 2 in the retracted position as shown in FIG. 1.

As described referring to FIG. 1, the embodiment is capable of aligning the front surface of the front plate 24 with the front surface of the printer cover 91 in the left-right direction. FIG. 4 shows the stopper frame 22 and the boss 27*a* of the mounting portion 27 (see FIG. 2) where the stopper frame 22 is mounted. The stopper frame 22 in the most retracted position is shown in a solid line while the stopper frame 22 in the most advanced position is shown in a two-dash dot line. The pair of through-holes 221*a* of the stopper frame 22 are respectively diagonally elongated with respect to the front-rear direction as shown by two-way arrows. The stopper frame 22 is adjusted in the most retracted position when the screw 23 is joined on the stopper frame 22 with the boss 27*a* positioned in the most advanced position (obliquely left downward) within the through-holes 221*a*. The stopper frame 22 is adjusted in the most advanced position when the screw 23 is joined on the stopper frame 22 with the boss 27*a* positioned in the most retracted position (obliquely right upward) within the through-holes 221*a*. The stopper frame 22 is adjustable in the front-rear direction within a range of C between the most retracted position and the most advanced position.

As shown in FIG. 3A, the engaging surface 72*a* of the lock frame 7 in the locked state is extended substantially parallel to the left-right direction when in a certain position. Adjusting the stopper frame 22 to be engaged with the engaging surface 72*a* in the front-rear direction enables the front plate 24 to be adjusted in the front-rear direction. The front surface of the front plate 24 is thereby aligned with the front surface of the printer cover 91 in the left-right direction. The through-hole 221*a* may be elongated in the front-rear direction, in which configuration, however, the screw 23 would likely come loose when forward load is applied to the drawer 2, causing an unexpected shift of the lock frame 7 and deterioration of the locked state. In the embodiment, the through-hole 221*a* is diagonally elongated with respect to the front-rear direction to keep the screw 23 held even when forward load is applied to the drawer 2.

The lock frame 7 is provided with a hitting portion 73 which hits against the first stopper 411 of the top plate 41 when rotated in a counter-clockwise direction, and also with an attaching portion 74, which is bent downward, on which an other end 822 of the tension coil spring 82 is attached. The tension coil spring 82 is connected to the projection 523 of the hook gear 5 on the end 821 thereof while to the attaching portion 74 of the lock frame 7 on the other end 822. See FIG. 5B-1. The tension coil spring 82 urges the hook gear 5 and the lock frame 7 in a counter-clockwise rotating direction. Urging force of the tension coil spring 82 is set larger than the revolving force for the two-step planetary gear 62 by the DC motor 81. The lock 71 is thereby urged toward the planetary gear unit 6 in the locked state.

Figures 4, 6A:
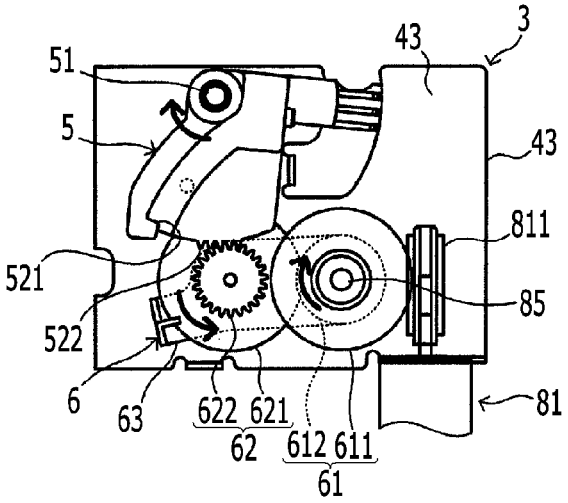
Figures 4, 6B:
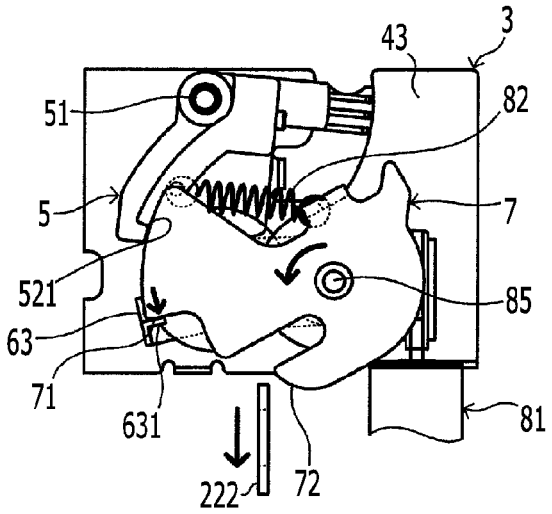
Figures 5, 6A:
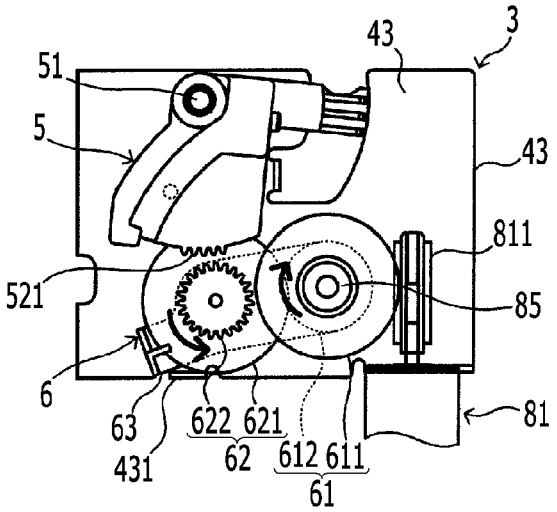
Figures 5, 6B:
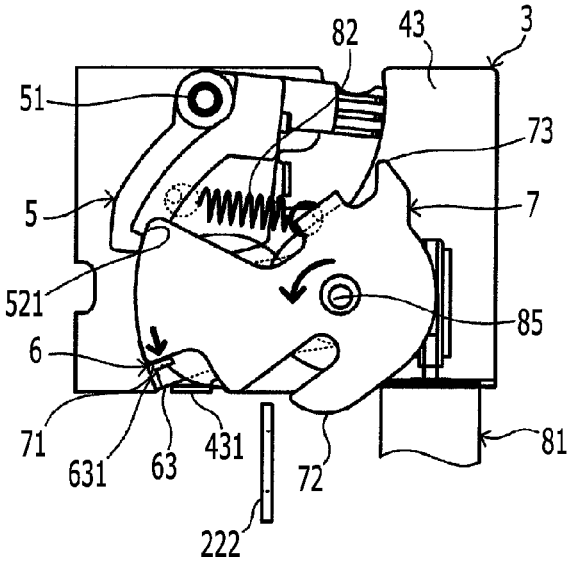

FIG. 5 and FIG. 6 totally show the manner in which the locked state of the lock unit 3 is released. In the (a) drawings on the left side, the top plate 41, the lock frame 7, and the tension coil spring 82 are omitted to show the motion of the hook gear 5 and the planetary gear unit 6. In the (b) drawings on the right side, the lock frame 7, the tension coil spring 82, and the engaging portion 222 of the stopper frame 22 are added to show the motion of the hook gear 5, the lock frame 7, and the engaging portion 222. In FIG. 6C-5, the top plate 41 is further added to show engagement of the lock frame 7 with the top plate 41.

FIG. 5A-1 and FIG. 5B-1 show the lock unit 3 in the locked state as in FIG. 3A. The planetary gear unit 6 is in a default position in which, as shown in FIG. 5A-1, the base 63 of the planetary gear unit 6 hits against the second stopper 431 of the bottom plate 43 while the smaller-diameter planetary gear 622 is kept apart from the gear 522 of the hook gear 5. As shown in FIG. 5B-1, in a state in which the hook 521 of the hook gear 5 is engaged with the lock 71 of the lock frame 7, the hook gear 5 is urged by the tension coil spring 82 in the counter-clockwise rotating direction around the pivot 51 while the lock frame 7 is urged by the same in the counter-clockwise rotating direction around the shaft 85. The hook 521 and the lock 71 are thereby urged toward the approaching direction to each other to keep engagement. In the state in which the hook 521 is engaged with the lock 71, the anchor 72 of the lock frame 7 is kept in a position with the engaging surface 72*a* thereof kept substantially parallel to the left-right direction. As described referring to FIG. 2, the drawer 2 is urged forward (in the advancing direction) by the compression coil spring 923. The engaging surface 72*a* of the anchor 72 is engaged with the engaging portion 222 of the stopper frame 22 to anchor the urged drawer 2 in the retracted position.

Upon completion of a transaction, for example, when paper is cut by the cutter apparatus of the printer housed in the housing 90 as shown in FIG. 1, a drawer-kick signal is output from the POS terminal or the printer via a driving circuit for the cash drawer 10. The drawer-kick signal is a power supply of about 0.5 to 1.0 second to the DC motor 81. In response to the drawer-kick signal, torque of the DC motor 81 is transmitted to the two-step sun gear 61. Rotation of the DC motor 81 is uni-directional. The two-step sun gear 61 is rotated in the clockwise direction, and then the two-step planetary gear 62 is revolved in the clockwise direction around the shaft 85 as shown in FIG. 5A-2. The smaller-diameter planetary gear 622 is brought into engagement with the gear 522 of the hook gear 5. The planetary gear unit 6 is thereby shifted into an engaged state, in which the locked state is still maintained without motion of the hook gear 5 and the lock frame 7.

In the engaged state, torque of the DC motor 81 is transmitted to the two-step planetary gear 62 via the two-step sun gear 61. The two-step planetary gear 62 is rotated in the counter-clockwise direction around the pin 87 to cause the hook gear 5 to rotate in the clockwise direction with the gear 522 thereof engaged with the smaller-diameter planetary gear 622 as shown in FIG. 5A-3. Rotation of the hook gear 5 in the clockwise direction releases the hook 521 from the lock 71 of the lock frame 7 as shown in FIG. 5B-3. The release of the hook 521 causes rotation of the lock frame 7 in the counter-clockwise direction by urging force in the counter-clockwise direction applied to the lock frame 7 by the tension coil spring 82 and by urging force applied to the anchor 72 engaged with the engaging portion 222 by the compression coil spring 923.

Rotation of the lock frame 7 in the counter-clockwise direction releases the anchor 72 from the engaging portion 222. The drawer 2 is then advanced from the retracted position (FIG. 2), and the lock 71 hits against the abutment part 631 of the planetary gear unit 6 as shown in FIG. 6B-4. Rotation of the hook gear 5 in the clockwise direction is continued in the engaged state in which the smaller-diameter planetary gear 622 is engaged with the gear 522 of the hook gear 5.

Figures 5, 6C:
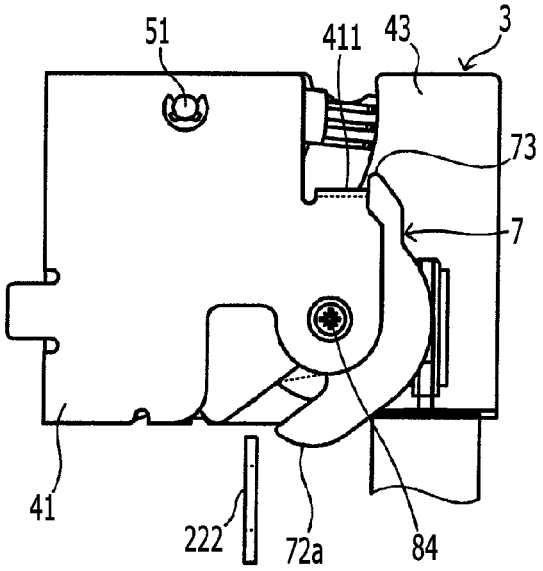

The lock frame 7 is further rotated in the counter-clockwise direction after hitting against the abutment part 631 of the planetary gear unit 6. The planetary gear unit 6 is pushed by the lock frame 7 as shown in FIG. 6B-5 and rotated in the counter-clockwise direction along with the lock frame 7. Rotation of the planetary gear unit 6 stops when the base 63 thereof hits against the second stopper 431. Rotation of the lock frame 7 stops when the hitting portion 73 thereof hits against the first stopper 411 of the top plate 41 as shown in FIG. 6C-5. Alternatively, the lock frame 7 may be modified to stop when the base 63 of the planetary gear unit 6 hits against the second stopper 431 without using the first stopper 411 of the top plate 41. As shown in FIG. 6A-5, rotation of the planetary gear unit 6 in the counter-clockwise direction along with the lock frame 7 causes the smaller-diameter planetary gear 622 to revolve in the counter-clockwise direction. The planetary gear unit 6 is then brought into the default state in which the smaller-diameter planetary gear 622 is apart from the gear 522 of the hook gear 5. As described before, since urging force applied to the lock frame 7 is larger than the revolving force applied to the two-step planetary gear 62, the two-step planetary gear 62 in the released state remains in the default state. As a result, the two-step planetary gear 62 is only (idly) rotated around the pin 87 without transmission of motor torque to the hook gear 5, eliminating the need for stop control of the DC motor 81. Further, uni-directional rotation of the DC motor 81 in the engaged state releases the hook 521 from the lock 71. No control is required for the hook 521 and the lock 71 for their disengagement. Either of them can be position-controlled without sensor detection.

As shown in FIG. 6B-5 and FIG. 6C-5, the lock frame 7 is in a default state in which the lock frame 7 is ready to receive the engaging portion 222 when the drawer 2 advanced from the retracted position is pushed back to the retracted position. Specifically, the anchor 72 is retracted in a position out of reach of the engaging portion 222 pushed back to the retracted position.

FIG. 7 totally shows the manner in which the components of the lock unit 3 in the locked state as shown in FIG. 5A-1 and FIG. 5B-1 are moved when the drawer-kick signal is output while the drawer is disturbed by a user or forcibly locked by a key. In the (c) drawings on the left side, the top plate 41, the lock frame 7, and the tension coil spring 82 are omitted to show the motion of the hook gear 5 and the planetary gear unit 6. In the (d) drawings on the right side, the lock frame 7, the tension coil spring 82, and the engaging portion 222 of the stopper frame 22 are added to show the motion of the hook gear 5, the lock frame 7, and the engaging portion 222.

Figures 1, 7C:
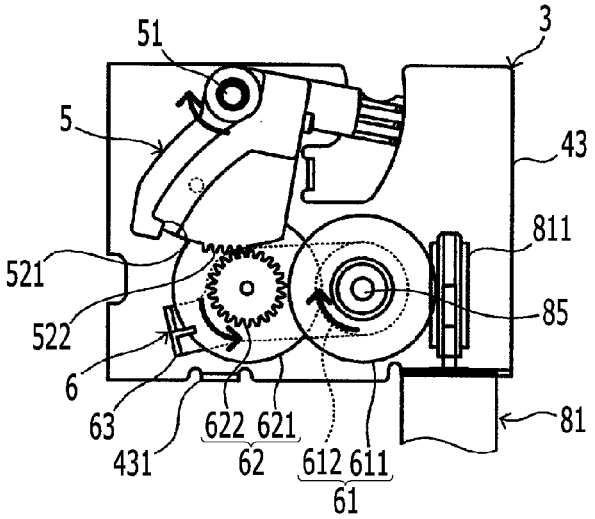
Figures 2, 7C:
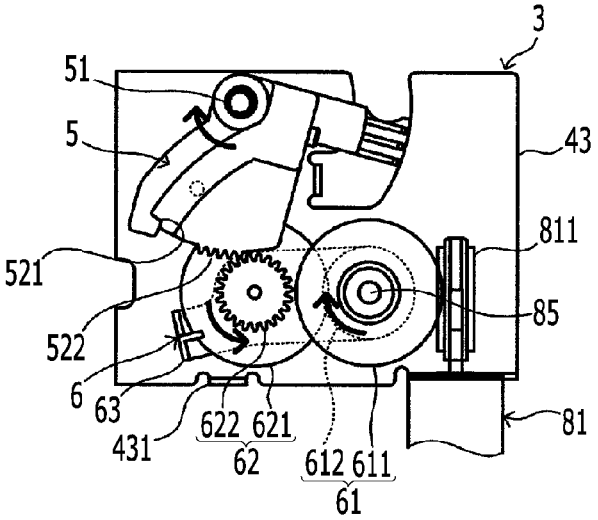
Figures 1, 7D:
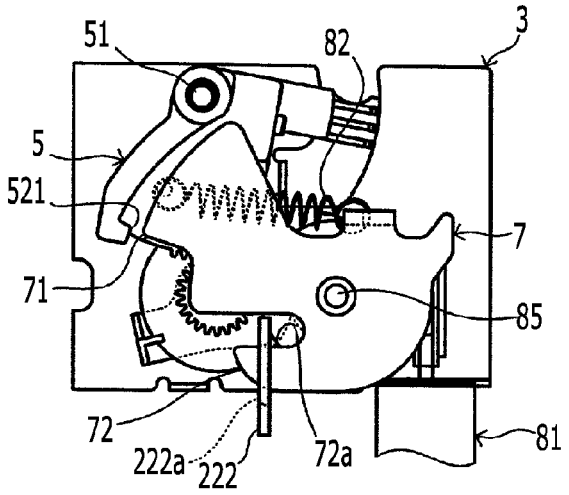
Figures 2, 7D:
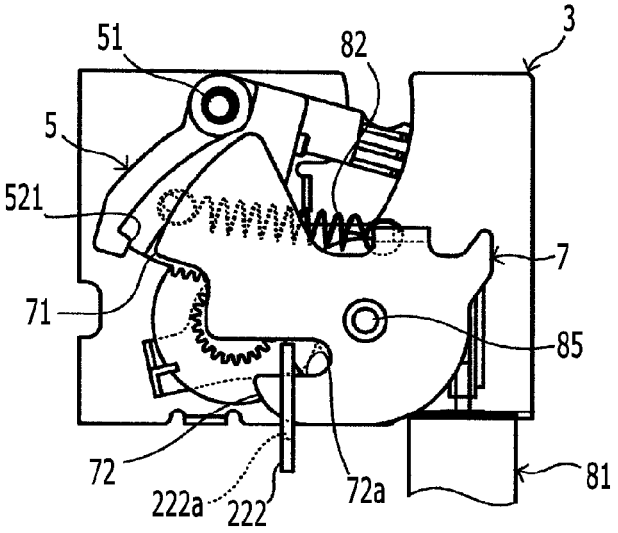

When the drawer-kick signal is output in the locked state while the drawer is forcibly disturbed, the DC motor 81 is driven to rotate the hook gear 5 in the clockwise direction as shown in FIG. 7C-1 and then the hook 521 is released from the lock 71 as shown in FIG. 7D-1. The engaging portion 222, however, remains in the position since the drawer is forcibly stored in the retracted position. Rotation of the lock frame 7 is prevented by the engaging portion 222, and the engaged state of the smaller-diameter planetary gear 622 and the gear 522 is maintained.

The gear 522 has a predetermined number of tooth (five in this embodiment). As the hook gear 5 is continuously rotated by the DC motor 81, the engaged state of the smaller-diameter planetary gear 622 and the gear 522 is released as shown in FIG. 7C-2, bringing the smaller-diameter planetary gear 622 into an idling state. Idling of the smaller-diameter planetary gear 622 stops upon completion of power supply of about 0.5 to 1.0 second for the drawer-kick signal. Rotation of the DC motor 81 is possibly stopped when the engaged state of the smaller-diameter planetary gear 622 and the gear 522 is continued beyond the rotational range of the hook gear 5. In this embodiment, the risk of motor lock is eliminated by using the gear 522 having the predetermined number of tooth to release the engaged state within the rotational range of the hook gear 5. The number of tooth of the gear 522 may be appropriately determined according to the range of the hook gear 5, a period of power supply and other factors. Upon release from the forcibly disturbed state as shown in FIG. 7C-2 and FIG. 7D-2, the drawer 2 is advanced in the advancing direction by urging force of the compression coil spring 923 (FIG. 2).

Figures 1, 8E:
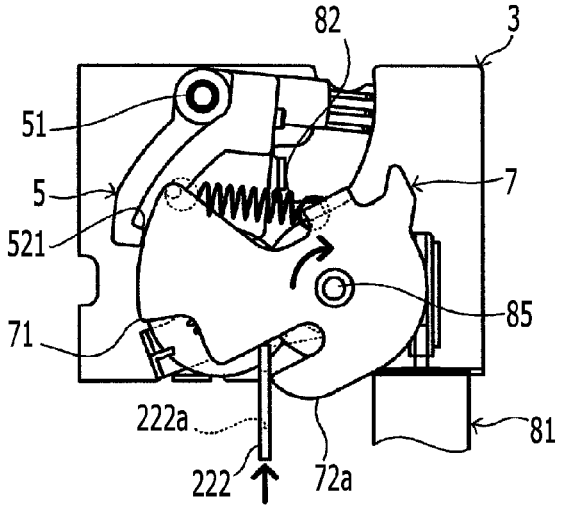
Figures 2, 8E:
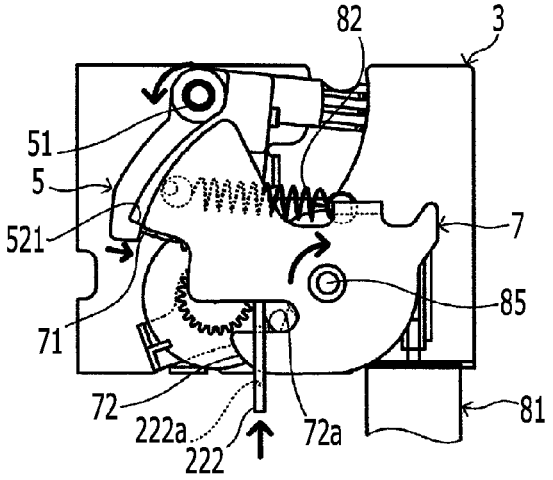

FIG. 8 totally shows the manner in which the lock unit 3 with the lock frame 7 in the default state as shown in FIG. 6B-5 is brought into the locked state as shown in FIG. 5B-1 by pushing back the drawer 2 to the retracted position. FIG. 8E-1 and FIG. 8E-2 corresponds to FIG. 5B and FIG. 6B in which the top plate 41 is omitted to show the motion of the hook gear 5, the lock frame 7 and the engaging portion 222.

When the drawer 2 is pushed back toward the retracted position, the lock frame 7 in the default state as shown in FIG. 6B-5 is rotated in the clockwise direction by the engaging portion 222 of the drawer 2 as shown in FIG. 8E-1.

When the drawer 2 reaches the retracted position, the anchor 72 of the lock frame 7 goes into the engaging hole 222*a* of the engaging portion 222 as shown in FIG. 8E-2. bringing the engaging portion 222 of the drawer 2 into engagement with the anchor 72 of the lock frame 7. The lock 71 of the lock frame 7 is rotated beyond the hook 521 of the hook gear 5, causing the hook gear 5 to rotate in the counter-clockwise direction by urging force of the tension coil spring 82. The lock unit 3 is then brought into the locked state as shown in FIG. 5B-1. No position-control is required for the hook 521 and the lock 71 for their engagement. The lock frame 7 after disengagement remains in the default state ready to receive the engaging portion 222 of the drawer 2 pushed back to the housed portion. This elements the need of motor reverse control, position-control by using a sensor, and motor stop control for the lock frame 7 to be shifted into the default state.

The cash drawer 10 of the embodiment provides the drawer 2 capable of being locked and unlocked without any position control or motor stop control. The invention eliminates the need of a sensor or a control board for position control or motor stop control, thereby reducing a cost of the apparatus and a human error.

The scope of the invention is not limited to the embodiment. The invention may be embodied in various forms without departing from the scope of the invention. For example, the planetary gear unit 6 may be pushed by any part other than the lock 71 of the lock frame 7 to be shifted from the engaged state into the default state. The hook gear 5 and the lock frame 7 may be respectively urged by separate springs, not by the single tension coil spring 82 though use of the single tension coil spring 82 is advantageous in decreasing the number of components.

What is claimed is:

1. A drawer apparatus comprising:

a drawer urged in an advancing direction when the drawer is disposed in a retracted position:

a hooker having a hook and a gear;

a motor:

a transmitter to be shifted from a default state to an engaged state by rotation of the motor, the transmitter being provided with a transmission gear which is separated from the gear in the default state while engaged with the gear in the engaged state to be rotated by torque of the motor; and a locker provided with a lock to be engaged with the hook in a locked state and with an anchor to be engaged with the drawer in the retracted position in the locked state;

wherein the locker is released from the hook to be brought into an operable state when the motor is rotated in one direction in the engaged state;

wherein the drawer is released from the anchor to be advanced out of the retracted position when the locker is brought into the operable state;

wherein the transmitter is pushed by the locker in the operable state;

wherein the transmission gear is shifted from the engaged state to the default state when the transmitter is pushed by the locker in the operable state;

wherein the anchor is engaged with the drawer when the advanced drawer is pushed back to the retracted position; and wherein the hook is engaged with the lock when the advanced drawer is pushed back to the retracted position.

2. The drawer apparatus of claim 1, wherein the lock of the locker is urged toward the transmitter in the locked state.

3. The drawer apparatus of claim 1, wherein the locker in the operable state pushes the transmitter in a direction to separate the transmission gear from the gear by a stronger force than a force to shift the transmitter from the default state to the engaged state by rotation of the motor.

4. The drawer apparatus of claim 1, wherein the transmission gear comprises a planetary gear.

5. The drawer apparatus of claim 2, wherein the transmission gear comprises a planetary gear.

6. The drawer apparatus of claim 3, wherein the transmission gear comprises a planetary gear.

7. The drawer apparatus of claim 1, wherein the gear is released from the transmission gear when the transmission gear continues to be rotated in one direction in the engaged state.

8. The drawer apparatus of claim 2, wherein the gear is released from the transmission gear when the transmission gear continues to be rotated in one direction in the engaged state.

9. The drawer apparatus of claim 5, wherein the gear is released from the transmission gear when the transmission gear continues to be rotated in one direction in the engaged state.

10. The drawer apparatus of claim 1, wherein the lock is rotated to move toward the transmitter.

11. The drawer apparatus of claim 2, wherein the lock is rotated to move toward the transmitter.

12. The drawer apparatus of claim 3, wherein the lock is rotated to move toward the transmitter.

13. The drawer apparatus of claim 1 further comprising an urging member adapted to urge the lock toward the transmitter in the locked state.

14. The drawer apparatus of claim 2 further comprising an urging member adapted to urge the lock toward the transmitter in the locked state.

15. The drawer apparatus of claim 13, wherein the urging member further urges the hook toward the lock in the locked state.

16. The drawer apparatus of claim 14, wherein the urging member further urges the hook toward the lock in the locked state.

* * * * *